US009843085B2

(12) United States Patent
Katabuchi et al.

(10) Patent No.: US 9,843,085 B2
(45) Date of Patent: Dec. 12, 2017

(54) DIRECTIONAL COUPLER

(71) Applicant: Murata Manufacturing Co., Ltd., Nagaokakyo-shi, Kyoto-fu (JP)

(72) Inventors: Keisuke Katabuchi, Nagaokakyo (JP); Tetsuo Taniguchi, Nagaokakyo (JP); Yasushi Yunoki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/364,937

(22) Filed: Nov. 30, 2016

(65) Prior Publication Data

US 2017/0084979 A1 Mar. 23, 2017

Related U.S. Application Data

(63) Continuation of application No. 14/463,919, filed on Aug. 20, 2014, now Pat. No. 9,543,632.

(30) Foreign Application Priority Data

Oct. 22, 2013 (JP) ..... 2013-219480
Jul. 2, 2014 (JP) ..... 2014-136397

(51) Int. Cl.
*H01P 5/18* (2006.01)
*H03H 7/38* (2006.01)

(52) U.S. Cl.
CPC ..... *H01P 5/18* (2013.01); *H01P 5/184* (2013.01); *H01P 5/187* (2013.01); *H01P 5/185* (2013.01)

(58) Field of Classification Search
CPC ..... H01P 5/18; H01P 3/08; H03H 7/38
(Continued)

(56) References Cited

U.S. PATENT DOCUMENTS 5,369,379 A * 11/1994 Fujiki ..... H01P 5/185 333/116
5,689,217 A 11/1997 Gu et al.
(Continued)

FOREIGN PATENT DOCUMENTS

JP 2000-278167 A 10/2000
JP 2001-144513 A 5/2001
(Continued)

OTHER PUBLICATIONS

Katabuchi et al., "Directional Coupler", U.S. Appl. No. 14/463,919, filed Aug. 20, 2014.
(Continued)

*Primary Examiner* — Dean Takaoka
(74) *Attorney, Agent, or Firm* — Keating & Bennett, LLP

(57) ABSTRACT

A directional coupler includes a multilayer body including a plurality of stacked dielectric layers, a main line including a first main line portion and a second main line portion which are connected in series to each other in this order and that is provided in the multilayer body, and a sub-line including a first sub-line portion and a second sub-line portion which are connected in series to each other in this order, the first sub-line portion being electromagnetically coupled to the first main line portion, the second sub-line portion being electromagnetically coupled to the second main line portion, and the sub-line being provided on one side in a stacking direction with respect to the main line in the multilayer body. The second main line portion is provided on a dielectric layer that is different from a dielectric layer on which the first main line portion is provided and/or the second sub-line portion is provided on a dielectric layer that is different from a dielectric layer on which the first sub-line portion is provided.

19 Claims, 8 Drawing Sheets

(58) Field of Classification Search
USPC ..... 333/109–112, 116
See application file for complete search history.

(56) References Cited

U.S. PATENT DOCUMENTS

| | | | | |
|---|---|---|---|---|
| 6,208,220 | B1 * | 3/2001 | Logothetis | H01P 5/185 333/116 |
| 6,515,556 | B1 | 2/2003 | Kato et al. | |
| 6,825,738 | B2 * | 11/2004 | Shumovich | H01P 5/185 333/112 |
| 9,000,864 | B2 * | 4/2015 | Tanaka | H01P 5/184 333/116 |
| 9,543,632 | B2 * | 1/2017 | Katabuchi | H01P 5/184 |

FOREIGN PATENT DOCUMENTS

| | | | |
|---|---|---|---|
| JP | 2002-330008 | A | 11/2002 |
| JP | 2008-244924 | A | 10/2008 |

OTHER PUBLICATIONS

Official Communication issued in corresponding Japanese Patent Application No. 2014-136397, dated Feb. 8, 2017.

* cited by examiner

DIRECTIONAL COUPLER

BACKGROUND OF THE INVENTION

1. Field of the Invention

The present invention relates to a directional coupler, and more particularly, to a directional coupler which includes a main line and a sub-line that are electromagnetically coupled to each other.

2. Description of the Related Art

For example, a known directional coupler is disclosed in Japanese Patent No. 3203253. In the directional coupler, a first coupling line in a spiral or substantially spiral shape faces a second coupling line in the same shape as the first coupling line with a dielectric layer therebetween. With this configuration, the first coupling line and the second coupling line are electromagnetically coupled to each other and form a directional coupler.

With the directional coupler described in Japanese Patent No. 3203253, in order to make a fine adjustment of the degree of coupling between the first coupling line and the second coupling line, adjusting the thickness of the dielectric layer provided between the first coupling line and the second coupling line is considered. However, since the first coupling line is provided on one dielectric layer and the second coupling line is provided on another dielectric layer, adjusting the thickness of the dielectric layer provided between the first coupling line and the second coupling line causes the entire first coupling line and the entire second coupling line to be closer to or farther away from each other. Therefore, the degree of coupling between the first coupling line and the second coupling line will greatly vary. As described above, it is difficult for the directional coupler described in Japanese Patent No. 3203253 to make a fine adjustment of the degree of coupling between the first coupling line and the second coupling line.

SUMMARY OF THE INVENTION

Accordingly, preferred embodiments of the present invention provide a directional coupler which is capable of making a fine adjustment of the degree of coupling between a main line and a sub-line.

According to a preferred embodiment of the present invention, a directional coupler includes a multilayer body including a plurality of stacked dielectric layers; a main line that includes a first main line portion and a second main line portion which are connected in series to each other in this order and that is provided in the multilayer body; and a sub-line that includes a first sub-line portion and a second sub-line portion which are connected in series to each other in this order, the first sub-line portion being electromagnetically coupled to the first main line portion, the second sub-line portion being electromagnetically coupled to the second main line portion, and the sub-line being provided on one side in a stacking direction with respect to the main line in the multilayer body. The second main line portion is provided on a dielectric layer that is different from a dielectric layer on which the first main line portion is provided and/or the second sub-line portion is provided on a dielectric layer that is different from a dielectric layer on which the first sub-line portion is provided.

According to various preferred embodiments of the present invention, a fine adjustment of the degree of coupling between a main line and a sub-line is achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, directional couplers according to preferred embodiments of the present invention will be described.

First Preferred Embodiment

Figure 1:
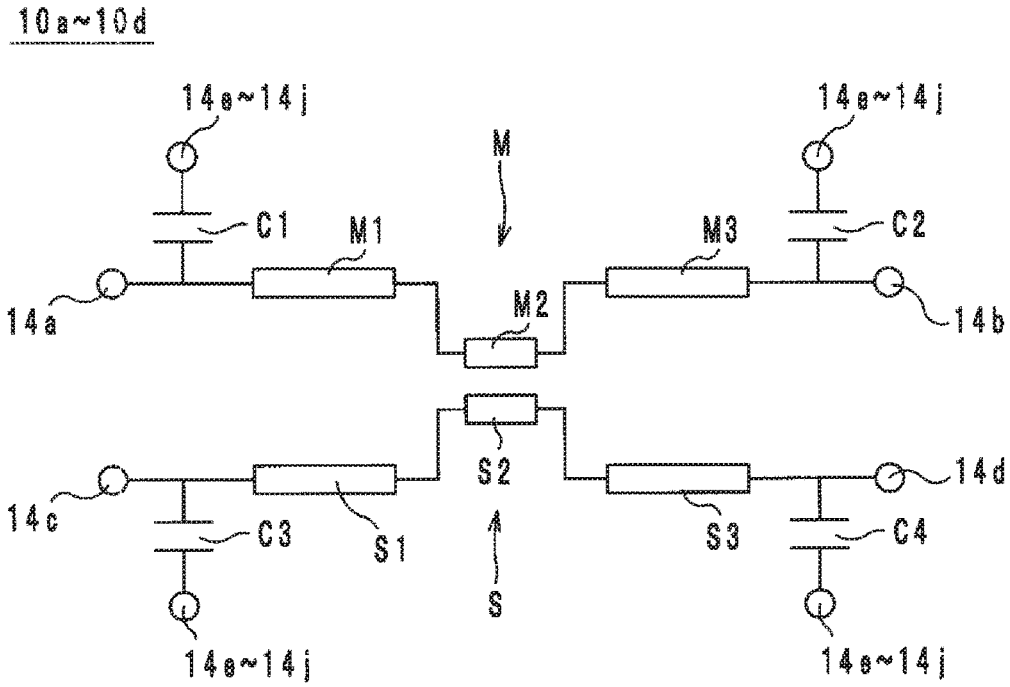
FIG. 1 is an equivalent circuit diagram of directional couplers according to first to fifth preferred embodiments of the present invention.

Hereinafter, a directional coupler according to a first preferred embodiment will be described with reference to drawings. FIG. 1 is an equivalent circuit diagram of directional couplers 10*a* to 10*e* according to the first to fifth preferred embodiments of the present invention.

A circuit configuration of the directional coupler 10*a* will be described below. The directional coupler 10*a* is used in a specific frequency band. A specific frequency band is, for example, a frequency band (for example, about 698 MHz to about 3800 MHz) in which a Long Term Evolution (LTE) is used.

The directional coupler 10*a* includes outer electrodes 14*a* to 14*j*, a main line M, a sub-line S, and capacitors C1 to C4 as a circuit configuration. The main line M is connected between the outer electrodes 14*a* and 14*b*, and includes main line portions M1 to M3. The main line portions M1 to M3 are connected in series in this order between the outer electrodes 14*a* and 14*b*.

The sub-line S is connected between the outer electrodes 14*c* and 14*d*, and includes sub-line portions S1 to S3. The sub-line portions S1 to S3 are connected in series in this order between the outer electrodes 14*c* and 14*d*.

Furthermore, the main line portion M1 and the sub-line portion S1 are electromagnetically coupled to each other. The main line portion M2 and the sub-line portion S2 are electromagnetically coupled to each other. The main line portion M3 and the sub-line portion S3 are electromagnetically coupled to each other. The main line portion M2 and the sub-line portion S2 are, as will be described later, in closer proximity than the main line portion M1 and the sub-line portion S1 and than the main line portion M3 and the sub-line portion S3.

The capacitor C1 is connected between the outer electrode 14*a* and the outer electrodes 14*e* to 14*j*. The capacitor C2 is connected between the outer electrode 14*b* and the outer electrodes 14*e* to 14*j*. The capacitor C3 is connected between the outer electrode 14*c* and the outer electrodes 14*e* to 14*j*. The capacitor C4 is connected between the outer electrode 14*d* and the outer electrodes 14*e* to 14*j*.

In the directional coupler 10*a*, the outer electrode 14*a* is used as an input port, and the outer electrode 14*b* is used as an output port. Furthermore, the outer electrode 14*c* is used as a coupling port, and the outer electrode 14*d* is used as a terminating port which terminates in about 50Ω, for example. Furthermore, the outer electrode 14*e* to 14*j* are used as ground ports being connected to the ground. When a signal is input to the outer electrode 14*a*, the signal is output from the outer electrode 14*b*. Furthermore, since the main line M and the sub-line S are electromagnetically coupled to each other, a signal having a power proportional to the power of the signal output from the outer electrode 14*b* is output from the outer electrode 14*c*.

Figure 2:
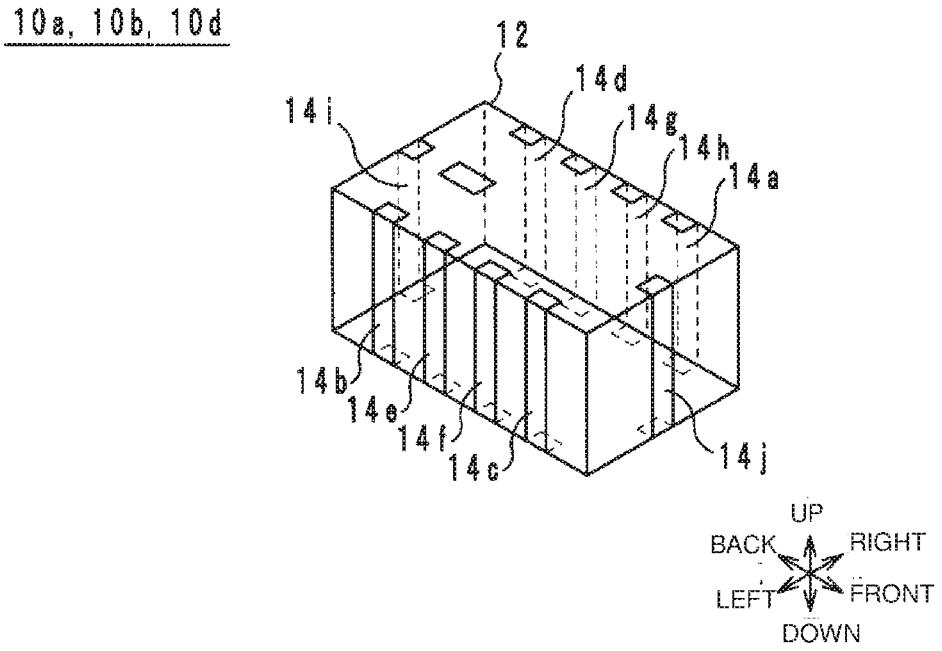
FIG. 2 is an external perspective view of the directional couplers according to the first, second, and fourth preferred embodiments of the present invention.
Figure 3:
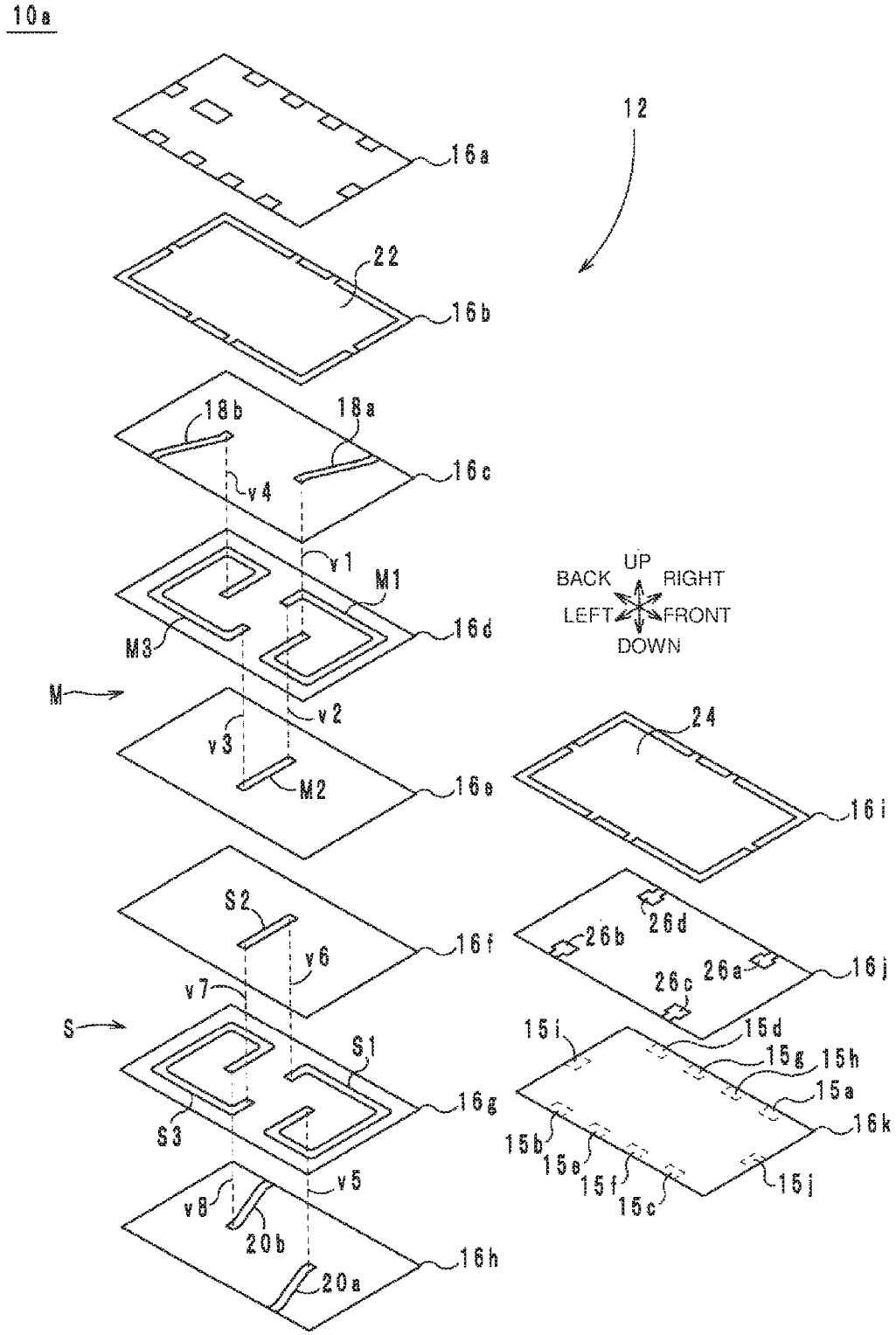
FIG. 3 is an exploded perspective view of a multilayer body of the directional coupler according to the first preferred embodiment of the present invention.

Next, a specific configuration of the directional coupler 10*a* according to the first preferred embodiment will be described with reference to drawings. FIG. 2 is an external perspective view of the directional couplers 10*a*, 10*b*, and 10*d* according to the first, second, and fourth preferred embodiments. FIG. 3 is an exploded perspective view of a multilayer body 12 of the directional coupler 10*a* according to the first preferred embodiment. Hereinafter, a stacking direction of the multilayer body 12 is defined as a vertical direction, a long-side direction of the directional coupler 10*a* when viewed in plan from above is defined as a longitudinal direction, and a short-side direction of the directional coupler 10*a* when viewed in plan from above is defined as a horizontal direction.

As illustrated in FIGS. 2 and 3, the directional coupler 10*a* includes the multilayer body 12; the outer electrodes 14*a* to 14*j*; the main line M; the sub-line S; lead conductors 18*a*, 18*b*, 20*a*, and 20*b*; ground conductors 22 and 24; capacitor conductors 26*a* to 26*d*; and via-hole conductors v1, v4, v5, and v8.

As illustrated in FIG. 2, the multilayer body 12 preferably has a rectangular or substantially rectangular parallelepiped shape, and as illustrated in FIG. 3, the multilayer body 12 is configured by stacking dielectric layers 16*a* to 16*k* each having a rectangular or substantially rectangular parallelepiped shape and made from dielectric ceramic materials, in this order from the top to the bottom. Hereinafter, an up-side main surface of the multilayer body 12 will be referred to as an upper surface, and a down-side main surface of the multilayer body 12 will be referred to as a lower surface. A front-side end surface of the multilayer body 12 will be referred to as a front surface, and a back-side end surface of the multilayer body 12 will be referred to as a back surface. A right-side side surface of the multilayer body 12 will be referred to as a right surface, and a left-side side surface of the multilayer body 12 will be referred to as a left surface. The bottom surface of the multilayer body 12 is a mounting surface which faces a circuit board when the directional coupler 10*a* is mounted on the circuit board. Furthermore, upper surfaces of the dielectric layers 16*a* to 16*k* will be referred to as first surfaces, and lower surfaces of the dielectric layers 16*a* to 16*k* will be referred to as second surfaces.

The outer electrodes 14*b*, 14*e*, 14*f*, and 14*c* are provided on the left surface of the multilayer body 12 so as to be aligned in this order from the back side to the front side. The outer electrodes 14*b*, 14*e*, 14*f*, and 14*c* extend in the vertical direction and are bent onto the upper surface and the bottom surface of the multilayer body 12.

The outer electrodes 14*d*, 14*g*, 14*h*, and 14*a* are provided on the right surface of the multilayer body 12 so as to be aligned in this order from the back side to the front side. The outer electrodes 14*d*, 14*g*, 14*h*, and 14*a* extend in the vertical direction and are bent onto the upper surface and the bottom surface of the multilayer body 12.

The outer electrode 14*i* extends in the vertical direction on the back surface of the multilayer body 12 and is bent onto the upper surface and the bottom surface of the multilayer body 12. The outer electrode 14*j* extends in the vertical direction on the front surface of the multilayer body 12 and is bent onto the upper surface and the bottom surface of the multilayer body 12.

The main line M is provided within the multilayer body 12, and includes the main line portions M1 to M3 and via-hole conductors v2 and v3. The main line portion M1, which is a first main line portion, is a linear conductor provided on a front half portion of the first surface of the dielectric layer 16*d*. When viewed in plan from above, the main line portion M1 inner-circumferentially extends with only substantially one turn in a counterclockwise direction from a start point located at the center of the front half portion of the dielectric layer 16*d* towards an end point located on the right side against the center (intersection of the diagonals) of the dielectric layer 16*d*. The main line portion M1 is in the form of substantially one turn. However, the main line portion M1 may be configured to inner-circumferentially extend with multiple turns. Hereinafter, the start point of the main line portion M1 will be referred to as an upstream end, and the end point of the main line portion M1 will be referred to as a downstream end.

The main line portion M3 is a linear conductor provided on a back half portion of the first surface of the dielectric layer 16*d*. When viewed in plan from above, the main line portion M3 inner-circumferentially extends with only substantially one turn in a clockwise direction from a start point located on the left side against the center (intersection of the diagonals) of the dielectric layer 16*d* towards an end point located at the center of the back half portion of the dielectric layer 16*d*. The main line portion M3 is in the form of substantially one turn. However, the main line portion M3 may be configured to inner-circumferentially extend with multiple turns.

The main line portion M3 has the same shape as the main line portion M1. In more detail, when rotating the main line portion M3 by about 180 degrees around the center of the dielectric layer 16*d*, the shape of the main line portion M3 matches the shape of the main line portion M1. That is, the main line portion M1 and the main line portion M3 are point-symmetric to each other with respect to the center of the dielectric layer 16*d*. Hereinafter, the start point of the main line portion M3 will be referred to as an upstream end, and the end point of the main line portion M3 will be referred to as a downstream end.

The main line portion M2, which is a second main line portion, is provided on the first surface of the dielectric layer 16*e*, which is different from the dielectric layer 16*d* on which the main line portions M1 and M3 are provided. In the directional coupler 10*a*, the main line portion M2 is provided at a position lower than the main line portions M1 and M3. The main line portion M2 is a linear conductor which extends in the horizontal direction at the center of the longitudinal direction of the dielectric layer 16*e*, and electrically connects the downstream end of the main line portion M1 with the upstream end of the main line portion M3. The length of the main line portion M2 is shorter than each of the lengths of the main line portions M1 and M3. When viewed in plan from above, the start point of the main line portion M2 and the downstream end of the main line portion M1 overlap. When viewed in plan from above, the end point of the main line point M2 and the upstream end of the main line portion M3 overlap. Hereinafter, the start point of the main line portion M2 will be referred to as an upstream end, and the end point of the main line portion M2 will be referred to as a downstream end. The main line portions M1 to M3 are preferably formed by applying conductive paste mainly composed of metal, such as Cu or Ag, onto the first surfaces of the dielectric layers 16*d* and 16*e*.

The via-hole conductor v2 penetrates through the dielectric layer 16*d* in the vertical direction, and connects the downstream end of the main line portion M1 with the upstream end of the main line portion M2. The via-hole conductor v3 penetrates through the dielectric layer 16*d* in the vertical direction, and connects the downstream end of the main line portion M2 with the upstream end of the main line portion M3. With this configuration, the main line portions M1 to M3 are connected in series in this order via the via-hole conductors v2 and v3. The via-hole conductors v2 and v3 are preferably formed by filling conductive paste mainly composed of metal, such as Cu or Ag, into via-holes provided in the dielectric layer 16*d*.

The lead conductor 18*a* is provided at a position above the main line M, and more specifically, the lead conductor 18*a* is a linear conductor in a straight or substantially straight line shape provided on the first surface of the dielectric layer 16*c*. When viewed in plan from above, one end portion of the lead conductor 18*a* and the upstream end of the main line portion M1 overlap. The other end portion of the lead conductor 18*a* is led to the long side on the right side of the dielectric layer 16*c*, and is connected to the outer electrode 14*a*.

The via-hole conductor v1 penetrates through the dielectric layer 16*c* in the vertical direction, and connects one end portion of the lead conductor 18*a* with the upstream end of the main line portion M1.

The lead conductor 18*b* is provided at a position above the main line M, and more specifically, the lead conductor 18*b* is a linear conductor in a straight or substantially straight line shape provided on the first surface of the dielectric layer 16*c*. When viewed in plan from above, one end portion of the lead conductor 18*b* and the downstream end of the main line portion M3 overlap. The other end portion of the lead conductor 18*b* is led to the long side on the left side of the dielectric layer 16*c*, and is connected to the outer electrode 14*b*.

The lead conductor 18*b* has the same shape as the lead conductor 18*a*. In more detail, when rotating the lead conductor 18*b* by about 180 degrees around the center of the dielectric layer 16*c*, the shape of the lead conductor 18*b* matches the shape of the lead conductor 18*a*. That is, the lead conductor 18*a* and the lead conductor 18*b* are point-symmetric to each other with respect to the center of the dielectric layer 16*c*.

The via-hole conductor v4 penetrates through the dielectric layer 16*c* in the vertical direction, and connects the one end portion of the lead conductor 18*b* with the downstream end of the main line portion M3. With this configuration, the main line M is connected between the outer electrodes 14*a* and 14*b*. The via-hole conductors v1 and v4 are preferably formed by filling conductive paste mainly composed of metal, such as Cu or Ag, into via-holes provided in the dielectric layer 16*c*.

The sub-line S is provided within the multilayer body 12, and includes the sub-line portions S1 to S3 and via-hole conductors v6 and v7. The sub-line portion S1, which is a first sub-line portion, is a linear conductor provided on a front half portion of the first surface of the dielectric layer 16*g*, and is electromagnetically coupled to the main line portion M1. When viewed in plan from above, the sub-line portion S1 has the same shape as the main line portion M1, and the sub-line portion S1 and the main line portion M1 overlap in such a manner that they correspond to each other. More specifically, when viewed in plan from above, the sub-line portion S1 inner-circumferentially extends with only substantially one turn in a counterclockwise direction from a start point located at the center of the front half portion of the dielectric layer 16*g* towards an end point located on the right side against the center (intersection of the diagonals) of the dielectric layer 16*g*. Hereinafter, the start point of the sub-line portion S1 will be referred to as an upstream end, and the end point of the sub-line portion S1 will be referred to as a downstream end.

The sub-line portion S3 is a linear conductor provided on a back half portion of the first surface of the dielectric layer 16*g*, and is electromagnetically coupled to the main line portion M3. When viewed in plan from above, the sub-line portion S3 has the same shape as the main line portion M3, and the sub-line portion S3 and the main line portion M3 overlap in such a manner that they correspond to each other. More specifically, when viewed in plan from above, the sub-line portion S3 inner-circumferentially extends with only substantially one turn in a clockwise direction from a start point located on the left side against the center (intersection of the diagonals) of the dielectric layer 16*g* towards an end point located at the center of the back half portion of the dielectric layer 16*g*.

The sub-line portion S3 has the same shape as the sub-line portion S1. In more detail, when rotating the sub-line portion S3 by about 180 degrees around the center of the dielectric layer 16*g*, the shape of the sub-line portion S3 matches the shape of the sub-line portion S1. That is, the sub-line portion S1 and the sub-line portion S3 are point-symmetric to each other with respect to the center of the dielectric layer 16*g*. Hereinafter, the start point of the sub-line portion S3 will be referred to as an upstream end, and the end point of the sub-line portion S3 will be referred to as a downstream end.

The sub-line portion S2, which is a second sub-line portion, is provided on the first surface of the dielectric layer 16*f*, which is different from the dielectric layer 16*e* on which the main line portion M2 is provided and the dielectric layer 16*g* on which the sub-line portions S1 and S3 are provided. In the directional coupler 10*a*, the sub-line portion S2 is provided at a position above the sub-line portions S1 and S3. With this configuration, the space between the main line portion M2 and the sub-line portion S2 is smaller than each of the space between the main line portion M1 and the sub-line portion S1 and the space between the main line portion M3 and the sub-line portion S3.

The sub-line portion S2 is a linear conductor which extends in the horizontal direction at the center of the longitudinal direction of the dielectric layer 16*f*. When viewed in plan from above, the sub-line portion S2 has the same shape as the main line portion M2, and the sub-line portion S2 and the main line portion M2 overlap in such a manner that they correspond to each other. The length of the sub-line portion S2 is shorter than each of the lengths of the sub-line portions S1 and S3. When viewed in plan from above, the start point of the sub-line portion S2 and the downstream end of the sub-line portion S1 overlap. When viewed in plan from above, the end point of the sub-line portion S2 and the upstream end of the sub-line portion S3 overlap. Hereinafter, the start point of the sub-line portion S2 will be referred to as an upstream end, and the end point of the sub-line portion S2 will be referred to as a downstream end. The sub-line portions S1 to S3 are preferably formed by applying conductive paste mainly composed of metal, such as Cu or Ag, onto the first surfaces of the dielectric layers 16*f* and 16*g*.

The via-hole conductor v6 penetrates through the dielectric layer 16*f* in the vertical direction, and connects the downstream end of the sub-line portion S1 with the upstream end of the sub-line portion S2. The via-hole conductor v7 penetrates through the dielectric layer 16*f* in the vertical direction, and connects the downstream end of the sub-line portion S2 with the upstream end of the sub-line portion S3. With this configuration, the sub-line portions S1 to S3 are connected in series in this order via the via-hole conductors v6 and v7. The via-hole conductors v6 and v7 are preferably formed by filling conductive paste mainly composed of metal, such as Cu or Ag, into via-holes provided in the dielectric layer 16*f*.

The lead conductor 20*a* is provided at a position lower than the sub-line S, and more specifically, the lead conductor 20*a* is a linear conductor in a straight or substantially straight line shape provided on the first surface of the dielectric layer 16*h*. When viewed in plan from above, one end portion of the lead conductor 20*a* and the upstream end of the sub-line portion S1 overlap. The other end portion of the lead conductor 20*a* is led to the long side on the left side of the dielectric layer 16*h*, and is connected to the outer electrode 14*c*. Furthermore, the lead conductor 20*a* has the same length as the lead conductor 18*a*. With this configuration, when viewed in plan from above, connecting the right end of the lead conductor 18*a* and the left end of the lead conductor 20*a* with a straight line defines an isosceles triangle.

The via-hole conductor v5 penetrates through the dielectric layer 16*g* in the vertical direction, and connects one end portion of the lead conductor 20*a* with the upstream end of the sub-line portion S1.

The lead conductor 20*b* is provided at a position lower than the sub-line S, and more specifically, the lead conductor 20*b* is a linear conductor in a straight or substantially straight line shape provided on the first surface of the dielectric layer 16*h*. When viewed in plan from above, one end portion of the lead conductor 20*b* and the downstream end of the sub-line portion S3 overlap. The other end portion of the lead conductor 20*b* is led to the long side on the right side of the dielectric layer 16*h*, and is connected to the outer electrode 14*d*. Furthermore, the lead conductor 20*b* has the same length as the lead conductor 18*b*. With this configuration, when viewed in plan from above, connecting the left end of the lead conductor 18*b* and the right end of the lead conductor 20*b* with a straight line defines an isosceles triangle.

The lead conductor 20*b* has the same shape as the lead conductor 20*a*. In more detail, when rotating the lead conductor 20*b* by about 180 degrees around the center of the dielectric layer 16*h*, the shape of the lead conductor 20*b* matches the shape of the lead conductor 20*a*. That is, the lead conductor 20*a* and the lead conductor 20*b* are point-symmetric to each other with respect to the center of the dielectric layer 16*h*. The lead conductors 18*a*, 18*b*, 20*a*, and 20*b* are preferably formed by applying conductive paste mainly composed of metal, such as Cu or Ag, onto the first surfaces of the dielectric layers 16*c* and 16*h*.

The via-hole conductor v8 penetrates through the dielectric layer 16*g* in the vertical direction, and connects one end portion of the lead conductor 20*b* with the downstream end of the sub-line portion S3. With this configuration, the sub-line S is connected between the outer electrodes 14*c* and 14*d*. The via-hole conductors v5 and v8 are preferably formed by filling conductive paste mainly composed of metal, such as Cu or Ag, into via-holes provided in the dielectric layer 16*g*.

The ground conductor 22 is provided in the multilayer body 12, and is provided at a position above the main line M, the sub-line S, and the lead conductors 18*a*, 18*b*, 20*a*, and 20*b*. In more detail, the ground conductor 22 is arranged so as to cover substantially the whole first surface of the dielectric layer 16*b*, and is in a rectangular or substantially rectangular parallelepiped shape. Furthermore, the ground conductor 22 is led to each side of the dielectric layer 16*b*, and is connected to the outer electrodes 14*e* to 14*j*. Moreover, the ground conductor 22 and the main line portions M1 to M3 overlap when viewed in plan from above.

The ground conductor 24 is provided in the multilayer body 12, and is provided at a position lower than the main line M, the sub-line S, and the lead conductors 18*a*, 18*b*, 20*a*, and 20*b*. In more detail, the ground conductor 24 is arranged so as to cover substantially the whole first surface of the dielectric layer 16*i*, and is in a rectangular or substantially rectangular parallelepiped shape. Furthermore, the ground conductor 24 is led to each side of the dielectric layer 16*i*, and is connected to the outer electrodes 14*e* to 14*j*. Moreover, the ground conductor 24 and the sub-line portions S1 to S3 overlap when viewed in plan from above. The ground conductors 22 and 24 are preferably formed by applying conductive paste mainly composed of metal, such as Cu or Ag, onto the first surfaces of the dielectric layers 16*b* and 16*i*.

The capacitor conductors 26*a* to 26*d* are provided in the multilayer body 12, and are provided at positions lower than the ground conductor 24. In more detail, the capacitor conductors 26*a* to 26*d* are conductors in a rectangular or substantially rectangular shape provided on the first surface of the dielectric layer 16*j*. The capacitor conductor 26*a* is led to the long side on the right side of the dielectric layer 16*j*, and is connected to the outer electrode 14*a*. Furthermore, the capacitor conductor 26*a* defines the capacitor C1 by facing the ground conductor 24 with the dielectric layer 16*i* therebetween. With this configuration, the capacitor C1 is connected between the outer electrode 14*a* and the outer electrodes 14*e* to 14*j*.

The capacitor conductor 26*b* is led to the long side on the left side of the dielectric layer 16*j*, and is connected to the outer electrode 14*b*. Furthermore, the capacitor conductor 26*b* forms the capacitor C2 by facing the ground conductor 24 with the dielectric layer 16*i* therebetween. With this configuration, the capacitor C2 is connected between the outer electrode 14*b* and the outer electrodes 14*e* to 14*j*.

The capacitor conductor 26*c* is led to the long side on the left side of the dielectric layer 16*j*, and is connected to the outer electrode 14*c*. Furthermore, the capacitor conductor 26*c* forms the capacitor C3 by facing the ground conductor 24 with the dielectric layer 16*i* therebetween. With this configuration, the capacitor C3 is connected between the outer electrode 14*c* and the outer electrodes 14*e* to 14*j*.

The capacitor conductor 26*d* is led to the long side on the right side of the dielectric layer 16*j*, and is connected to the outer electrode 14*d*. Furthermore, the capacitor conductor 26*d* defines the capacitor C4 by facing the ground conductor 24 with the dielectric layer 16*i* therebetween. With this configuration, the capacitor C4 is connected between the outer electrode 14*d* and the outer electrodes 14*e* to 14*j*. The capacitor conductors 26*a* to 26*d* are preferably formed by applying conductive paste mainly composed of Cu or Ag onto the first surface of the dielectric layer 16*j*.

With the directional coupler 10*a* configured as described above, a fine adjustment of the degree of coupling between the main line M and the sub-line S is achieved. In more detail, in the directional coupler 10*a*, the main line M is configured by connecting the main line portions M1 to M3 in series to each other. Furthermore, the main line portion M2 is provided on the dielectric layer 16*e*, which is different from the dielectric layer 16*d* on which the main line portions M1 and M3 are provided. Similarly, the sub-line S is configured by connecting the sub-line portions S1 to S3 in series to each other. Furthermore, the sub-line portion S2 is provided on the dielectric layer 16*f*, which is different from the dielectric layer 16*g* on which the sub-line portions S1 and S3 are provided. With this configuration, the space between the main line portion M2 and the sub-line portion S2 can be changed without changing the space between the main line portion M1 and the sub-line portion S1 and without changing the space between the main line portion M3 and the sub-line portion S3. More specifically, by reducing the thickness of the dielectric layer 16*e* and increasing the thicknesses of the dielectric layers 16*d* and 16*f*, the space between the main line portion M2 and the sub-line portion S2 is significantly reduced without changing the space between the main line portion M1 and the sub-line portion S1 and without changing the space between the main line portion M3 and the sub-line portion S3. With this configuration, the degree of coupling between the main line M and the sub-line S is slightly increased. In contrast, by increasing the thickness of the dielectric layer 16*e* and reducing the thicknesses of the dielectric layers 16*d* and 16*f*, the space between the main line portion M2 and the sub-line portion S2 is significantly increased without changing the space between the main line portion M1 and the sub-line portion S1 and without changing the space between the main line portion M3 and the sub-line portion S3. With this configuration, the degree of coupling between the main line M and the sub-line S is slightly reduced. As described above, with the directional coupler 10*a*, a fine adjustment of the degree of coupling between the main line M and the sub-line S is achieved.

Furthermore, the length of the main line portion M2 is shorter than each of the lengths of the main line portions M1 and M3, and the length of the sub-line portion S2 is shorter than each of the lengths of the sub-line portions S1 and S3. Therefore, in the case where the space between the main line portion M2 and the sub-line portion S2 is changed, the amount of change in the degree of coupling between the main line M and the sub-line S is small. Accordingly, with the directional coupler 10*a*, a fine adjustment of the degree of coupling between the main line M and the sub-line S is achieved.

Furthermore, since the main line portion M1 and the sub-line portion S1 overlap in such a manner that they correspond to each other, the main line portion M2 and the sub-line portion S2 overlap in such a manner that they correspond to each other, and the main line portion M3 and the sub-line portion S3 overlap in such a manner that they correspond to each other, the degree of coupling between the main line M and the sub-line S may be increased.

Furthermore, when viewed in plan from above, the main line portions M1 to M3 have the same shape, and the main line portions M1 to M3 and the sub-line portions S1 to S3 respectively overlap in such a manner that they correspond to each other. With this configuration, the structure of the main line M and the structure of the sub-line S are closer to each other. As a result, electrical characteristics, such as characteristic impedance, of the main line M, and electrical characteristics, such as characteristic impedance, of the sub-line S, are closer to each other. Therefore, a difference between the phase of a signal output from the outer electrode 14*b* and the phase of a signal output from the outer electrode 14*c* decreases. That is, phase difference characteristics of the directional coupler 10*a* is improved.

Furthermore, the main line portion M1 and the main line portion M3 inner-circumferentially extend in opposite directions. With this configuration, for example, in the case where a magnetic flux passes through the center of the main line portion M1 in an upward direction, a magnetic flux passes through the center of the main line portion M3 in a downward direction. Therefore, the magnetic flux passing through the center of the main line portion M1 makes a U-turn on the upper side of the main line M and passes through the center of the main line portion M3, and the magnetic flux passing through the center of the main line portion M3 makes a U-turn on the lower side of the main line M and passes through the center of the main line portion M1. That is, a closed magnetic path is provided in the main line M. With this configuration, a situation in which the magnetic flux generated by the main line M is disturbed by external influences is prevented. The same may be applied to the sub-line S.

Furthermore, the lead conductor 18*a* and the lead conductor 20*a* have the same length. Therefore, resistances and phase changes of the lead conductor 18*a* and the lead conductor 20*a* are equal or substantially equal to each other. Thus, electrical characteristics, such as, characteristic impedance between the outer electrodes 14*a* and 14*b*, and electrical characteristics, such as characteristic impedance between the outer electrodes 14*c* and 14*d*, are closer to each other. Moreover, the phase difference characteristics of the directional coupler 10*a* are improved. The same may be applied to the lead conductor 18*b* and the lead conductor 20*b*.

Furthermore, since the lead conductors 18*a*, 18*b*, 20*a*, and 20*b* are each in a straight or substantially straight line shape, connection with the outer electrodes is achieved with the shortest distance. Therefore, the resistances of these lead conductors are reduced, and unnecessary magnetic coupling and capacity coupling are reduced. Thus, insertion loss of the directional coupler 10*a* is decreased.

Furthermore, in the directional coupler 10*a*, the capacitor C1 is provided between the outer electrode 14*a* and the outer electrodes 14*e* to 14*j*, the capacitor C2 is provided between the outer electrode 14*b* and the outer electrodes 14*e* to 14*j*, the capacitor C3 is provided between the outer electrode 14*c* and the outer electrodes 14*e* to 14*j*, and the capacitor C4 is provided between the outer electrode 14*d* and the outer electrodes 14*e* to 14*j*. With this configuration, by adjusting the capacitances of the capacitors C1 to C4, the characteristic impedance between the outer electrodes 14*a* and 14*b* and the characteristic impedance between the outer electrodes 14*c* and 14*d* are adjusted. Accordingly, by making these characteristic impedances closer to each other, the phase difference characteristics of the directional coupler 10*a* are improved.

Furthermore, the ground conductor 22 is provided at a position above the main line M, the sub-line S, and the lead conductors 18*a*, 18*b*, 20*a*, and 20*b*. With this configuration, noise input to the directional coupler 10*a* from the top is absorbed by the ground conductor 22. As a result, input of noise to the main line M, the sub-line S, and the lead conductors 18*a*, 18*b*, 20*a*, and 20*b* is significantly reduced or prevented.

Furthermore, the ground conductor 24 is provided at a position lower than the main line M, the sub-line S, and the lead conductors 18*a*, 18*b*, 20*a*, and 20*b*. With this configuration, noise input to the directional coupler 10*a* from the bottom is absorbed by the ground conductor 24. As a result, input of noise to the main line M, the sub-line S, and the lead conductors 18*a*, 18*b*, 20*a*, and 20*b* is significantly reduced or prevented.

Furthermore, the ground conductor 24 is provided at a position between the main line M, the sub-line S, the lead conductors 18*a*, 18*b*, 20*a*, and 20*b*, and the capacitor conductors 26*a* to 26*d*. With this configuration, formation of unnecessary capacitance between the main line M, the sub-line S, the lead conductors 18*a*, 18*b*, 20*a*, and 20*b*, and the capacitor conductors 26*a* to 26*d* is significantly reduced or prevented.

Second Preferred Embodiment

Figure 4:
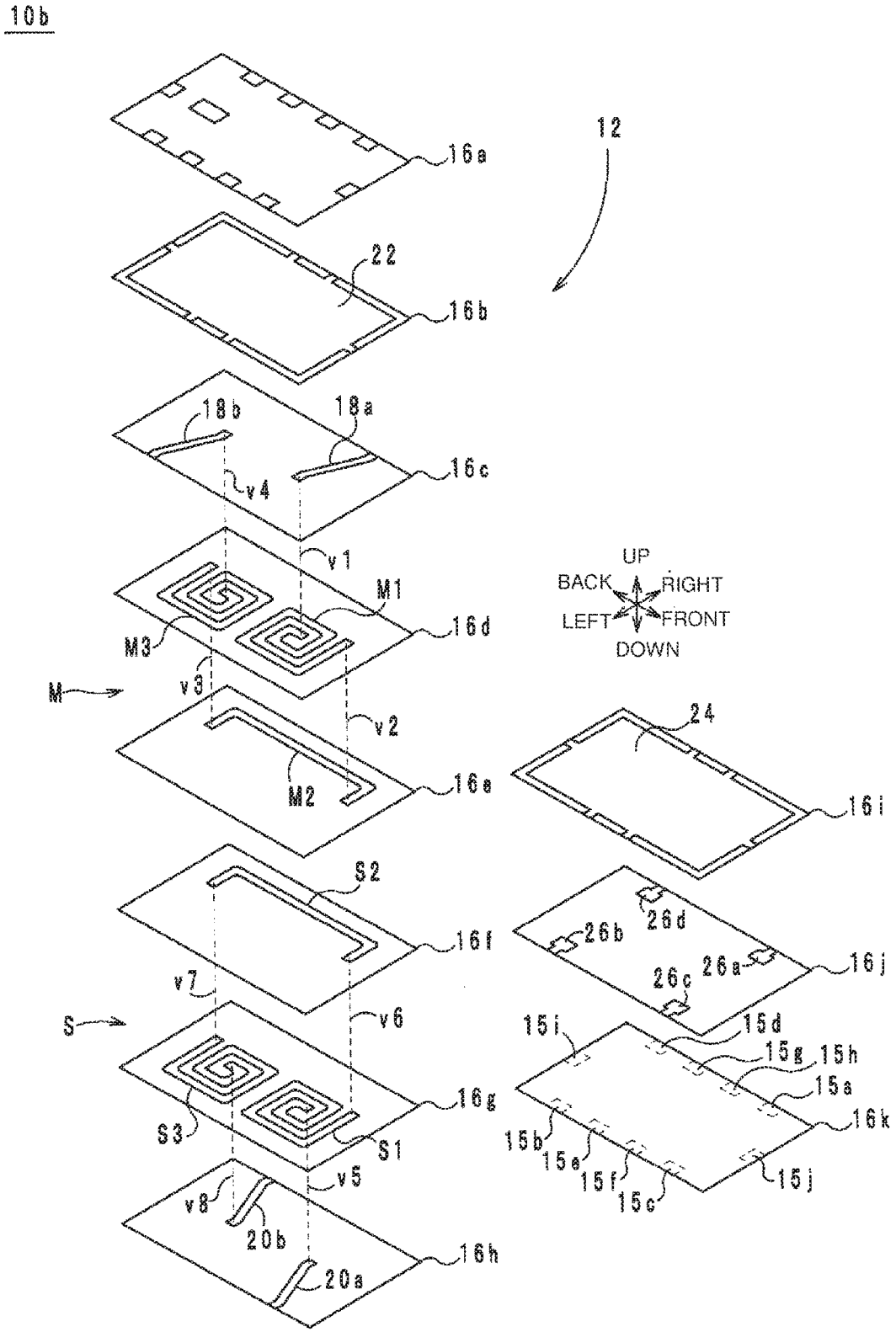
FIG. 4 is an exploded perspective view of a multilayer body of the directional coupler according to the second preferred embodiment of the present invention.

Hereinafter, a specific configuration of the directional coupler 10*b* according to a second preferred embodiment of the present invention will be explained with reference to drawings. FIG. 4 is an exploded perspective view of the multilayer body 12 of the directional coupler 10*b* according to the second preferred embodiment. Since the circuit configuration of the directional coupler 10*b* is the same as the circuit configuration of the directional coupler 10*a*, explanation of the circuit configuration of the directional coupler 10*b* will be omitted. FIG. 2 will be used as an external perspective view of the directional coupler 10*b*.

The directional coupler 10*b* differs from the directional coupler 10*a* in the shapes of the main line portions M1 to M3 and the sub-line portions S1 to S3. The directional coupler 10*b* will be explained below with focus on these differences.

When viewed in plan from above, the main line portion M1 has a spiral or substantially spiral shape which inner-circumferentially extends with plural turns in a counterclockwise direction from a start point located at the center of a front half portion of the dielectric layer 16*d* towards an end point located near the center of the short side on the front side of the dielectric layer 16*d*.

When viewed in plan from above, the main line portion M3 has a spiral or substantially spiral shape which inner-circumferentially extends with plural turns in a counterclockwise direction from a start point located near the center of the short side on the back side of the dielectric layer 16*d* towards an end point located at the center of a back half portion of the dielectric layer 16*d*. The main line portion M3 arranged as described above and the main line portion M1 are line-symmetric to each other with respect to a straight line horizontally passing through the center in the longitudinal direction of the dielectric layer 16*d*.

The main line portion M2 is provided on the first surface of the dielectric layer 16*e*. The main line portion M2 extends in the longitudinal direction, and both ends of the main line portion M2 are bent to the left. However, when viewed in plan from above, the main line portion M2 and the main line portions M1 and M3 do not overlap in portions other than the upstream end and the downstream end. The upstream end of the main line portion M2 is connected to the downstream end of the main line portion M1 via the via-hole conductor v2. The downstream end of the main line portion M2 is connected to the upstream end of the main line portion M3 via the via-hole conductor v3.

When viewed in plan from above, the sub-line portion S1 has a spiral or substantially spiral shape which inner-circumferentially extends with plural turns in a counterclockwise direction from a start point located at the center of a front half portion of the dielectric layer 16*g* towards an end point located near the center of the short side on the front side of the dielectric layer 16*g*.

When viewed in plan from above, the sub-line portion S3 has a spiral or substantially spiral shape which inner-circumferentially extends with plural turns in a counterclockwise direction from a start point located near the center of the short side on the back side of the dielectric layer 16*g* towards an end point located at the center of a back half portion of the dielectric layer 16*g*. The sub-line portion S3 arranged as described above and the sub-line portion S1 are line-symmetric to each other with respect to a straight line horizontally passing through the center in the longitudinal direction of the dielectric layer 16*g*.

The sub-line portion S2 is provided on the first surface of the dielectric layer 16*f*. The sub-line portion S2 extends in the longitudinal direction, and both ends of the sub-line portion S2 are bent to the left. However, when viewed in plan from above, the sub-line portion S2 and the sub-line portions S1 and S3 do not overlap in portions other than the upstream end and the downstream end. The upstream end of the sub-line portion S2 is connected to the downstream end of the sub-line portion S1 via the via-hole conductor v6. The downstream end of the sub-line portion S2 is connected to the upstream end of the sub-line portion S3 via the via-hole conductor v7.

The directional coupler 10*b* configured as described above achieves the same effects as those achieved by the directional coupler 10*a*.

Furthermore, in the directional coupler 10*b*, the main line M and the lead conductors 18*a* and 18*b*; and the sub-line S and the lead conductors 20*a* and 20*b* are line-symmetric to each other with respect to a straight line horizontally passing through the center in the longitudinal direction of the dielectric layers 16*d* and 16*g*. With this configuration, electrical characteristics, such as characteristic impedance, of the main line M and the lead conductors 18*a* and 18*b*, and electrical characteristics, such as characteristic impedance, of the sub-line S and the lead conductors 20*a* and 20*b*, are closer to each other. As a result, the phase difference characteristics of the directional coupler 10*b* are improved.

Furthermore, in the directional coupler 10*b*, the main line portions M1 and M2 and the sub-line portions S1 and S2 each have a spiral or substantially spiral shape. Therefore, in the case where the length of the main line portions M1 and M2 and the sub-line portions S1 and S2 of the directional coupler 10*b* and the length of the main line portions M1 and M2 and the sub-line portions S1 and S2 of the directional coupler 10*a* are the same, the area occupied by the main line portions M1 and M2 and the sub-line portions S1 and S2 in the directional coupler 10*b* is smaller than the area occupied by the main line portions M1 and M2 and the sub-line portions S1 and S2 in the directional coupler 10*a*. Accordingly, the size of the directional coupler 10*b* is made smaller than the size of the directional coupler 10*a*. In addition, with the sub-line portions S1 and S2 each having a spiral or substantially spiral shape, the lengths of the lines are increased. Therefore, lower frequencies may also be coped with. As a result, the directional coupler 10*b* which is capable coping with a wide frequency range from lower frequencies to higher frequencies is attained.

Furthermore, in the directional coupler 10*b*, the main line portions M1 and M2 and the sub-line portions S1 and S2 each have a spiral or substantially spiral shape. Therefore, in the case where the area occupied by the main line portions M1 and M2 and the sub-line portions S1 and S2 in the directional coupler 10*b* and the area occupied by the main line portions M1 and M2 and the sub-line portions S1 and S2 in the directional coupler 10*a* are the same, the length of the main line portions M1 and M2 and the sub-line portions S1 and S2 of the directional coupler 10*b* is longer than the length of the main line portions M1 and M2 and the sub-line portions S1 and S2 of the directional coupler 10*a*. Accordingly, the directional coupler 10*b* is capable of being used in frequencies lower than the directional coupler 10*a*.

Furthermore, when viewed in plan from above, the main line portion M2 and the main line portions M1 and M3 do not overlap in portions other than the upstream end and the downstream end. Therefore, the main line portion M2 does not interrupt a magnetic flux generated by the main line portions M1 and M3. Similarly, when viewed in plan from above, the sub-line portion S2 and the sub-line portions S1 and S3 do not overlap in portions other than the upstream end and the downstream end. Therefore, the sub-line portion S2 does not interrupt a magnetic flux generated by the sub-line portions S1 and S3.

Third Preferred Embodiment

Figure 5:
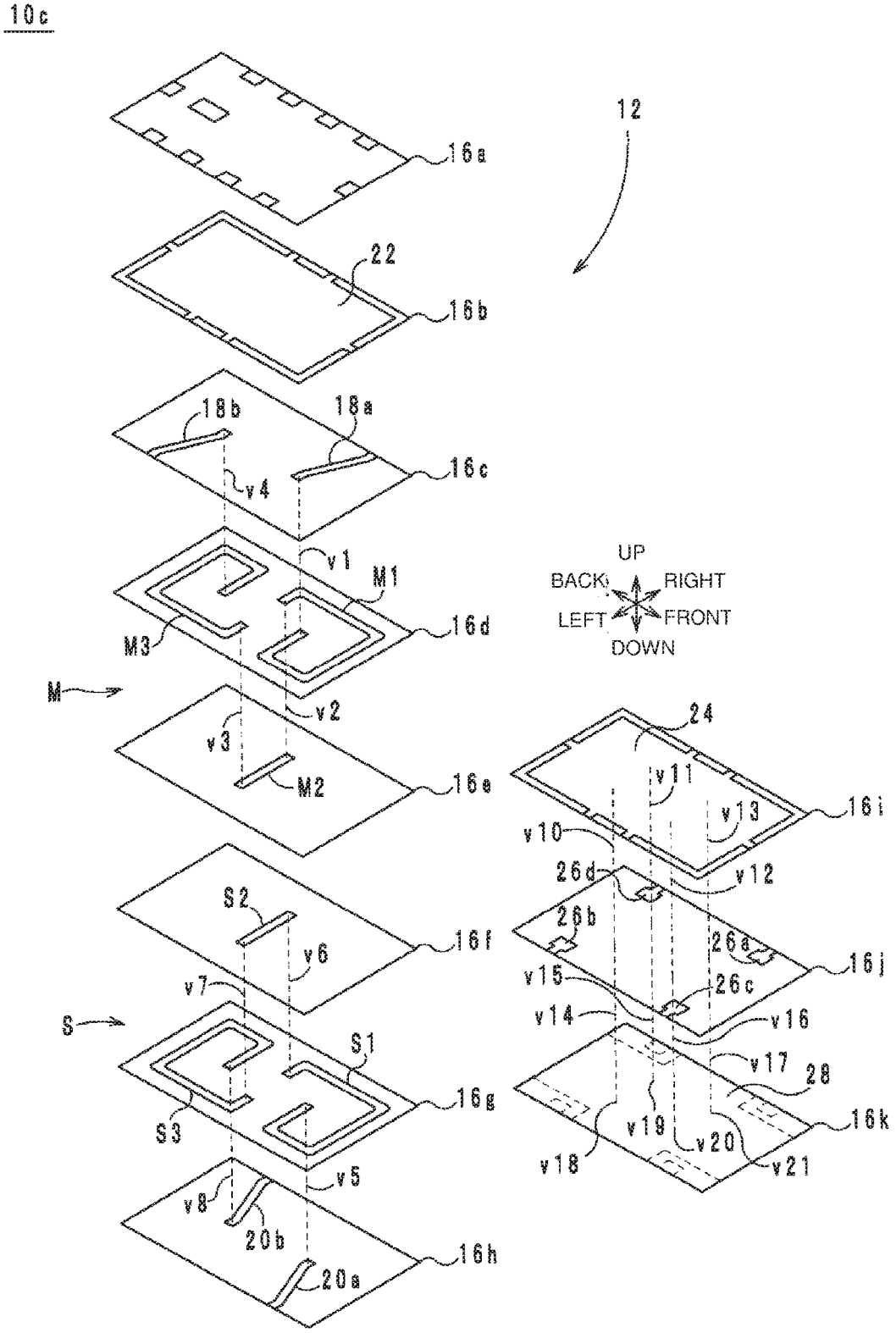
FIG. 5 is an exploded perspective view of a multilayer body of the directional coupler according to the third preferred embodiment of the present invention.

Hereinafter, a specific configuration of the directional coupler 10*c* according to a third preferred embodiment of the present invention will be explained with reference to drawings. FIG. 5 is an exploded perspective view of the multilayer body 12 of the directional coupler 10*c* according to the third preferred embodiment. Since the circuit configuration of the directional coupler 10*c* is the same as the circuit configuration of the directional coupler 10*a*, explanation of the circuit configuration of the directional coupler 10*c* will be omitted.

The directional coupler 10*c* differs from the directional coupler 10*a* in that the directional coupler 10*c* further includes a ground conductor 28 and via-hole conductors v10 to v21. The directional coupler 10*c* will be explained below with focus on these differences.

The ground conductor 28 is provided at the center of the bottom surface of the multilayer body 12, that is, at the center of the second surface of the dielectric layer 16*k*. The ground conductor 28 has a cross-shaped or a substantially cross-shaped configuration. More specifically, the ground conductor 28 includes a longitudinally-extending band-shaped conductor and a horizontally-extending band-shaped conductor which pass through the center of the dielectric layer 16*k*. Furthermore, by being led to the short side in the longitudinal direction of the dielectric layer 16*k* and to the long side in the horizontal direction of the dielectric layer 16*k*, the ground conductor 28 is connected to the outer electrodes 14*e* to 14*j*. However, the ground conductor 28 is not in contact with portions of the outer electrodes 14*a* to 14*d* that are bent onto the bottom surface.

The via-hole conductors v10, v14, and v18 penetrate through the dielectric layers 16*i* to 16*k* in the vertical direction. The via-hole conductors v10, v14, and v18 are connected to each other to define a via-hole conductor, and connect the ground conductor 24 with the ground conductor 28.

The via-hole conductors v11, v15, and v19 penetrate through the dielectric layers 16*i* to 16*k* in the vertical direction. The via-hole conductors v11, v15, and v19 are connected to each other to define a via-hole conductor, and connect the ground conductor 24 with the ground conductor 28.

The via-hole conductors v12, v16, and v20 penetrate through the dielectric layers 16*i* to 16*k* in the vertical direction. The via-hole conductors v12, v16, and v20 are connected to each other to define a via-hole conductor, and connect the ground conductor 24 with the ground conductor 28.

The via-hole conductors v13, v17, and v21 penetrate through the dielectric layers 16*i* to 16*k* in the vertical direction. The via-hole conductors v13, v17, and v21 are connected to each other to define a via-hole conductor, and connect the ground conductor 24 with the ground conductor 28.

The directional coupler 10*c* configured as described above achieves the same effects as those achieved by the directional coupler 10*a*.

Furthermore, the directional coupler 10*c* achieves a high heat dissipation. In more detail, when the directional coupler 10*c* is mounted on a circuit board, the ground conductor 28 is disposed in contact with the circuit board. The ground conductor 28, which is made of metal, has a thermal conductivity higher than the dielectric layer 16*k*, which is made from dielectric ceramic materials. Therefore, heat generated by the directional coupler 10*c* is efficiently transmitted to the circuit board via the ground conductor 28. Consequently, the heat dissipation of the directional coupler 10*c* is greatly improved.

Furthermore, since the ground conductor 24 and the ground conductor 28 are connected through the via-hole conductors v10 to v21, the ground conductor 24 is reliably maintained at the ground potential.

Fourth Preferred Embodiment

Figure 6:
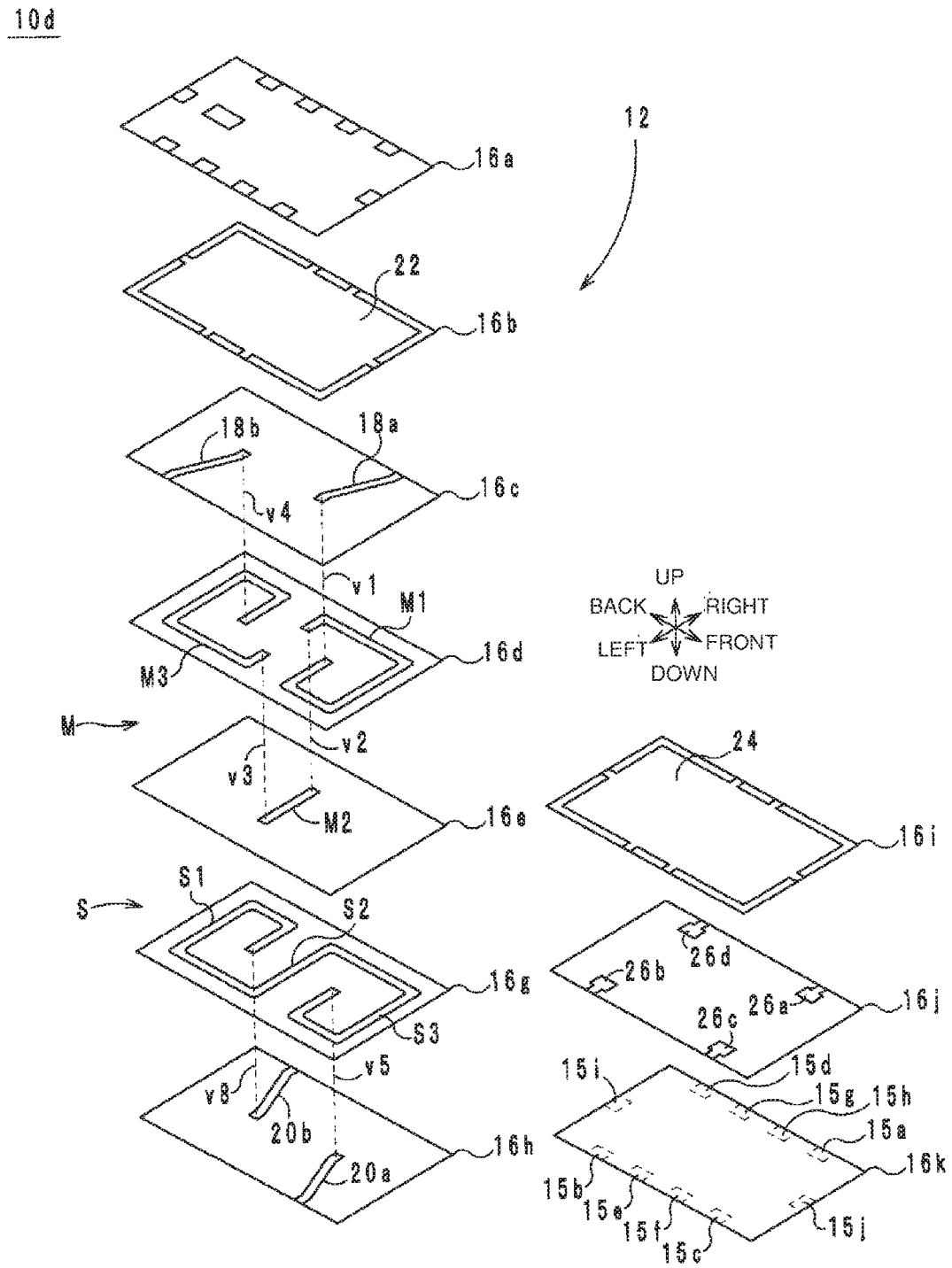
FIG. 6 is an exploded perspective view of a multilayer body of the directional coupler according to the fourth preferred embodiment of the present invention.

Hereinafter, a specific configuration of the directional coupler 10*d* according to the fourth preferred embodiment will be explained with reference to drawings. FIG. 6 is an exploded perspective view of the multilayer body 12 of the directional coupler 10*d* according to the fourth preferred embodiment. Since the circuit configuration of the directional coupler 10*d* is the same as the circuit configuration of the directional coupler 10*a*, explanation of the circuit configuration of the directional coupler 10*d* will be omitted. FIG. 2 will be used as an external perspective view of the directional coupler 10*d*.

The directional coupler 10*d* differs from the directional coupler 10*a* in that the directional coupler 10*d* does not include the dielectric layer 16*f* and that the sub-line portion S2 of the directional coupler 10*d* is provided on the first surface of the dielectric layer 16*g*. The directional coupler 10*d* will be explained below with focus on these differences.

The sub-line portion S2 is connected to the sub-line portion S1 and the sub-line portion S3 on the first surface of the dielectric layer 16*g*.

Also with the directional coupler 10*d* having the configuration described above, by adjusting the thicknesses of the dielectric layers 16*d* and 16*e*, the space between the main line portion M2 and the sub-line portion S2 is capable of being adjusted without changing the space between the main line portion M1 and the sub-line portion S1 and without changing the space between the main line portion M3 and the sub-line portion S3. Accordingly, also with the directional coupler 10*d*, a fine adjustment of the degree of coupling between the main line M and the sub-line S is achieved.

Furthermore, the number of dielectric layers of the directional coupler 10*d* is reduced by one compared to the number of dielectric layers of the directional coupler 10*a*.

In the directional coupler 10*d*, the main line portions M1 and M3 are provided on the first surface of the dielectric layer 16*d*, the main line portion M2 is provided on the first surface of the dielectric layer 16*e*, and the sub-line portions S1 to S3 are provided on the first surface of the dielectric layer 16*g*. However, the main line portions M1 to M3 may be provided on the first surface of the dielectric layer 16*d*, the sub-line portions S1 and S3 may be provided on the first surface of the dielectric layer 16*g*, and the sub-line portion S2 may be provided on the first surface of the dielectric layer 16*f*.

Fifth Preferred Embodiment

Figure 7:
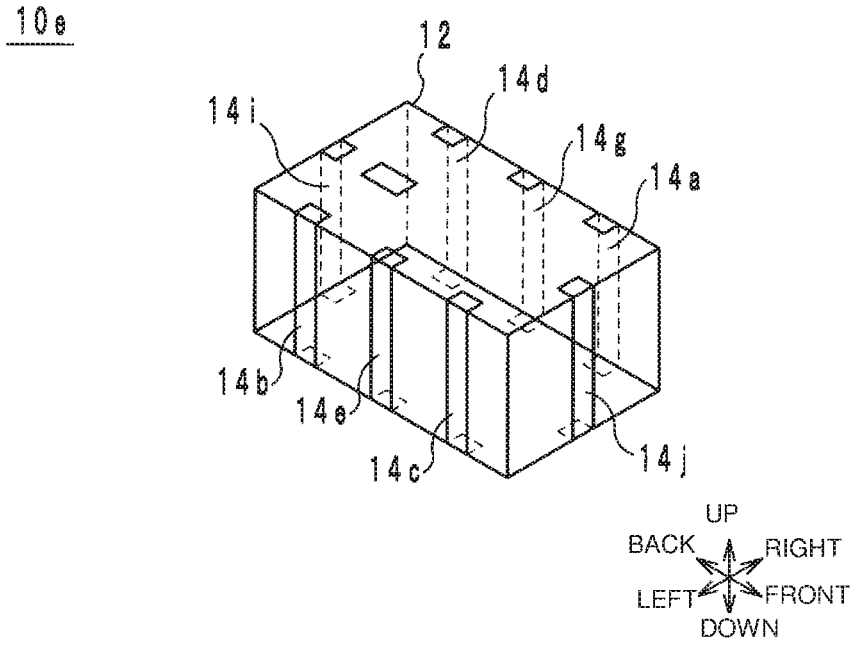
FIG. 7 is an external perspective view of a directional coupler according to a fifth preferred embodiment of the present invention.
Figure 8:
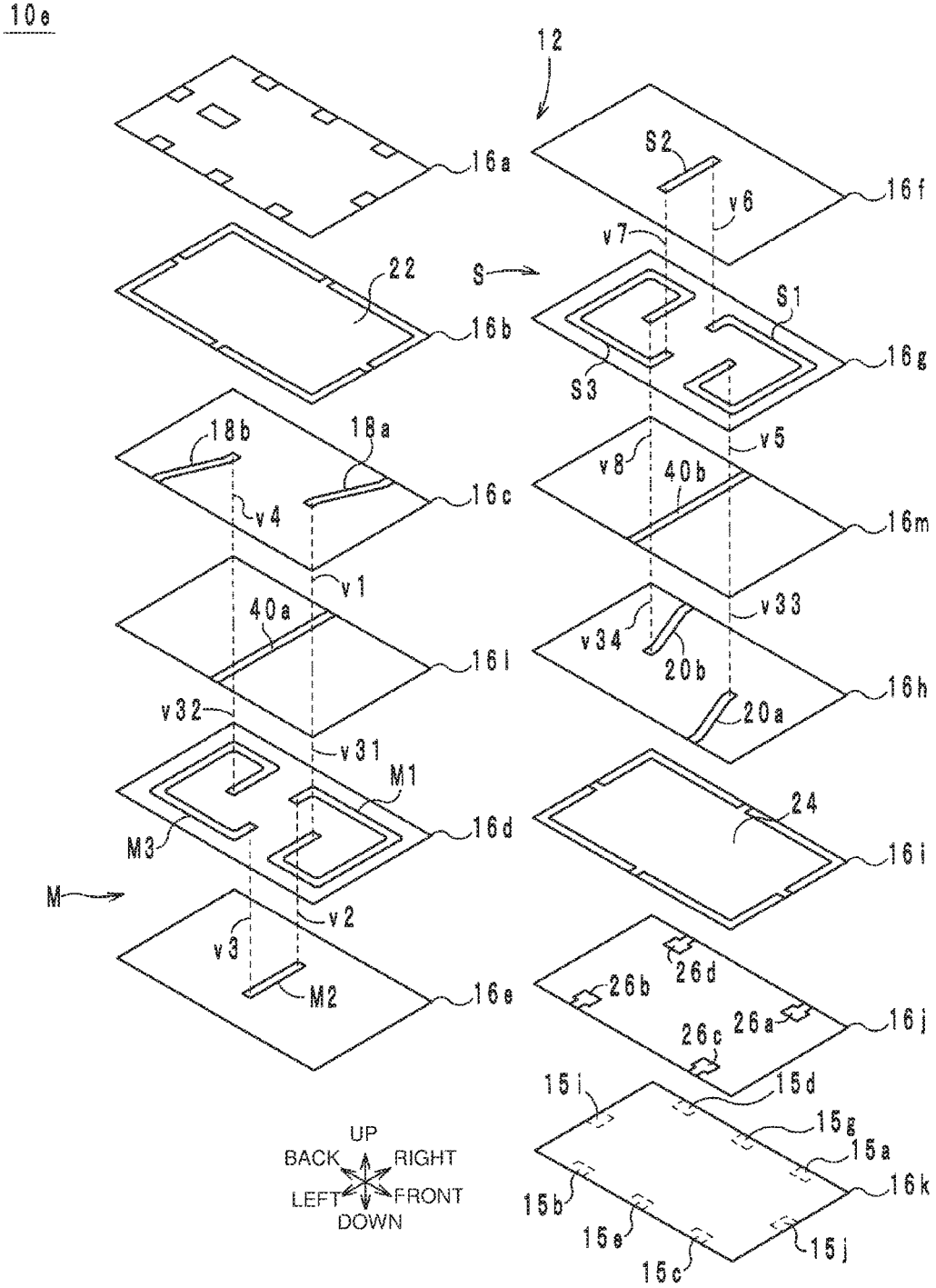
FIG. 8 is an exploded perspective view of a multilayer body of the directional coupler according to the fifth preferred embodiment of the present invention.

Hereinafter, a specific configuration of a directional coupler 10*e* according to a fifth preferred embodiment will be explained with reference to drawings. FIG. 7 is an external perspective view of the directional coupler 10*e* according to the fifth preferred embodiment. FIG. 8 is an exploded perspective view of the multilayer body 12 of the directional coupler 10*e* according to the fifth preferred embodiment. Since the circuit configuration of the directional coupler 10*e* is preferably the same or substantially the same as the circuit configuration of the directional coupler 10*a*, explanation of the circuit configuration of the directional coupler 10*e* will be omitted.

As illustrated in FIGS. 7 and 8, the directional coupler 10*e* differs from the directional coupler 10*a* in the following four points.

First difference: the outer electrodes 14*f* and 14*h* are not provided.

Second difference: a dielectric layer 16*l* is provided between the dielectric layer 16*c* and the dielectric layer 16*d*, and a dielectric layer 16*m* is provided between the dielectric layer 16*g* and the dielectric layer 16*h*.

Third difference: via-hole conductors v31 and v32 are provided in the dielectric layer 16*l*, and via-hole conductors v33 and v34 are provided in the dielectric layer 16*m*.

Fourth difference: a ground conductor 40*a* is provided on a first surface of the dielectric layer 16*l*, and a ground conductor 40*b* is provided on a first surface of the dielectric layer 16*m*.

The via-hole conductor v31 penetrates through the dielectric layer 16*l* in the vertical direction, and the via-hole conductor v31 and the via-hole conductor v1 configure a single via-hole conductor. The via-hole conductors v1 and v31 connect one end of the lead conductor 18*a* with the upstream end of the main line portion M1.

The via-hole conductor v32 penetrates through the dielectric layer 16*l* in the vertical direction, and the via-hole conductor v32 and the via-hole conductor v4 configure a single via-hole conductor. The via-hole conductors v4 and v32 connect one end of the lead conductor 18*b* with the downstream end of the main line portion M3.

The ground conductor 40*a* is provided at a position higher than the main line portions M1 to M3 and lower than the ground conductor 22, and more specifically, the ground conductor 40*a* is a linear conductor having a straight line or substantially straight line shape provided on the first surface of the dielectric layer 16*l*. The ground conductor 40*a* connects the center of the right-hand long side with the center of the left-hand long side of the dielectric layer 16*l*. Accordingly, the ground conductor 40*a* is connected to the outer electrodes 14*e* and 14*g*. Furthermore, the ground conductor 40*a* and the main line portion M2 overlap when viewed in plan from above.

The ground conductor 40*b* is provided at a position lower than the sub-line portions S1 to S3 and higher than the ground conductor 24, and more specifically, the ground conductor 40*b* is a linear conductor with a straight line or substantially straight line shape provided on the first surface of the dielectric layer 16*m*. The ground conductor 40*b* connects the center of the right-hand long side with the center of the left-hand long side of the dielectric layer 16*m*. Accordingly, the ground conductor 40*b* is connected to the outer electrodes 14*e* and 14*g*. Furthermore, the ground conductor 40*b* and the sub-line portion S2 overlap when viewed in plan from above.

Also with the directional coupler 10*e* having the configuration described above, by adjusting the thicknesses of the dielectric layers 16*d* and 16*e*, the space between the main line portion M2 and the sub-line portion S2 is capable of being adjusted without changing the space between the main line portion M1 and the sub-line portion S1 and without changing the space between the main line portion M3 and the sub-line portion S3. Accordingly, also with the directional coupler 10*e*, a fine adjustment of the degree of coupling between the main line M and the sub-line S is capable of being achieved.

Furthermore, the directional coupler 10*e* achieves improved transmission characteristics and coupling characteristics, compared to the directional coupler 10*a*. More specifically, in the directional coupler 10*a*, the main line portion M2 is provided at a position lower than the main line portions M1 and M3. Therefore, the distance in the vertical direction between the main line portion M2 and the ground conductor 22 is larger than the distance in the vertical direction between the main line portions M1 and M3 and the ground conductor 22. Thus, the capacitance generated between the main line portion M2 and the ground conductor 22 is smaller than the capacitance generated between the main line portions M1 and M3 and the ground conductor 22. Accordingly, the characteristic impedance of the main line portion M2 is higher than the characteristic impedance of the main line portions M1 and M3. Consequently, reflection of a high-frequency signal is generated between the main line portions M1 and M3 and the main line portion M2, and the transmission characteristics and coupling characteristics of the directional coupler 10*a* are thus decreased.

Thus, in the directional coupler 10*e*, the ground conductor 40*a* is provided at a position higher than the main line portions M1 to M3 and lower than the ground conductor 22, and the ground conductor 40*a* and the main line portion M2 overlap when viewed in plan from above. Accordingly, a capacitance is generated between the main line portion M2 and the ground conductor 40*a*. Consequently, the characteristic impedance of the main line portions M1 and M3 and the characteristic impedance of the main line portion M2 are made closer to each other. As a result, reflection of a high-frequency signal is prevented from being generated between the main line portions M1 and M3 and the main line portion M2, and the transmission characteristics and coupling characteristics of the directional coupler 10*e* are thus improved. The same effects as those of the main line portions M1 to M3 and the ground conductor 40*a* are achieved by the sub-line portions S1 to S3 and the ground conductor 40*b*.

Other Preferred Embodiments

A directional coupler according to the present invention is not limited to the directional couplers 10*a* to 10*e* according to the foregoing preferred embodiments. Various changes may be made to the present invention within the scope of the gist of the present invention.

The configurations of the directional couplers 10*a* to 10*e* may be combined together.

In the directional couplers 10*a* to 10*e*, the main line portion M2 and the sub-line portion S2 may be provided on the same dielectric layer. In this case, the main line portion M2 and the sub-line portion S2 are arranged on the dielectric layer in such a manner that they are different in position in the longitudinal direction and/or horizontal direction. By adjusting the space between the main line portion M2 and the sub-line portion S2 or adjusting the lengths of the main line portion M2 and the sub-line portion S2, a fine adjustment of the degree of coupling between the main line M and the sub-line S may be made.

In the directional couplers 10*a* to 10*e*, by changing the positions of the main line portion M2 or the sub-line portion S2 in the longitudinal direction and/or horizontal direction on an insulating layer, the space between the main line portion M2 and the sub-line portion S2 may be adjusted to make a fine adjustment of the degree of coupling between the main line M and the sub-line S.

Furthermore, in the directional couplers 10*a* to 10*e*, the line width of the main line portion M2 may be different from the line width of the sub-line portion S2. Similarly, the line width of the main line portion M1 may be different from the line width of the sub-line portion S1 or the line width of the main line portion M3 may be different from the line width of the sub-line portion S3. By adjusting the line widths of the main line portions M1 to M3 and the line widths of the sub-line portions S1 to S3, the characteristic impedance of the main line M and the characteristic impedance of the sub-line S are adjusted.

In the directional couplers 10*a*, 10*b*, 10*d*, and 10*e*, it is preferable that, when viewed in plan from above, the portions of the outer electrodes 14*a* to 14*d* that are bent onto the bottom surface (hereinafter, bent portions 15*a* to 15*d* (see FIG. 3)) are smaller than the capacitor conductors 26*a* to 26*d*, respectively, and are accommodated within the capacitor conductors 26*a* to 26*d* (that is, do not extend outside the capacitor conductors 26*a* to 26*d*), respectively. With this configuration, formation of unnecessary capacitance between the bent portions 15*a* to 15*d* and the ground conductor 24 is significantly reduced or prevented.

In the directional couplers 10*a* to 10*e*, the main line portion M1 or the main line portion M3 may not be provided. In this case, the main line portion M2 is connected to the lead conductor 18*a* or the lead conductor 18*b*. Similarly, the sub-line portion S1 or the sub-line portion S3 may not be provided. In this case, the sub-line portion S2 may be connected to the lead conductor 20*a* or the lead conductor 20*b*.

The main line portion M1 and the main line portion M3 may be provided on different dielectric layers.

The sub-line portion S1 and the sub-line portion S3 may be provided on different dielectric layers.

The shape of the main line portion M1 may be different from the shape of the sub-line portion S1. The shape of the main line portion M2 may be different from the shape of the sub-line portion S2. The shape of the main line portion M3 may be different from the shape of the sub-line portion S3.

The space between the main line portion M2 and the sub-line portion S2 may be greater than each of the space between the main line portion M1 and the sub-line portion S1 and the space between the main line portion M3 and the sub-line portion S3.

Preferred embodiments of the present invention are useful for a directional coupler, and more particularly, are excellent in that a fine adjustment of the degree of coupling between a main line and a sub-line is achieved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler comprising:

a multilayer body including a plurality of stacked dielectric layers;

a main line including a first main line portion and a second main line portion which are connected in series to each other in this order and that is provided in the multilayer body; and a sub-line that includes a first sub-line portion and a second sub-line portion which are connected in series to each other in this order, the first sub-line portion being electromagnetically coupled to the first main line portion, the second sub-line portion being electromagnetically coupled to the second main line portion, and the sub-line being provided on one side in a stacking direction with respect to the main line in the multilayer body; wherein the second main line portion is provided on a dielectric layer that is different from a dielectric layer on which the first main line portion is provided and/or the second sub-line portion is provided on a dielectric layer that is different from a dielectric layer on which the first sub-line portion is provided;

the second main line portion and the second sub-line portion are disposed such that a space between the second main line portion and the second sub-line portion is smaller than a space between the first main line portion and the first sub-line portion; and a line width of the second main line portion is different from a line width of the second sub-line portion.

2. The directional coupler according to claim 1, wherein the main line includes the first main line portion, the second main line portion, and a third main line portion that are connected in series to each other in this order;

the sub-line includes the first sub-line portion, the second sub-line portion, and a third sub-line portion that are connected in series to each other in this order, the third sub-line portion being electromagnetically coupled to the third main line portion;

the second main line portion is provided on a dielectric layer that is different from a dielectric layer on which the third main line portion is provided and/or the second sub-line portion is provided on a dielectric layer that is different from a dielectric layer on which the third sub-line portion is provided, and the second main line portion and the second sub-line portion are disposed such that a space between the second main line portion and the second sub-line portion is smaller than a space between the third main line portion and the third sub-line portion.

3. The directional coupler according to claim 2, wherein the second main line portion is provided on the one side in the stacking direction with respect to the first main line portion and the third main line portion; and the second sub-line portion is provided on the other side in the stacking direction with respect to the first sub-line portion and the third sub-line portion.

4. The directional coupler according to claim 2, wherein the second main line portion and the second sub-line portion overlap when the second main line portion and the second sub-line portion are viewed in plan from the stacking direction.

5. The directional coupler according to claim 4, wherein the second main line portion and the second sub-line portion have a same shape when the second main line portion and the second sub-line portion are viewed in plan from the stacking direction.

6. The directional coupler according to claim 2, wherein
the first main line portion has a shape which inner-circumferentially extends in a specific direction from an upstream end towards a downstream end;
the third main line portion has a shape which inner-circumferentially extends in a direction opposite the specific direction from an upstream end towards a downstream end; and
the second main line portion electrically connects the downstream end of the first main line portion with the upstream end of the third main line portion.

7. The directional coupler according to claim 2, wherein
the first main line has a shape which inner-circumferentially extends in a specific direction from an upstream end towards a downstream end;
the third main line has a shape which inner-circumferentially extends in the specific direction from an upstream end towards a downstream end; and
the second main line electrically connects the downstream end of the first main line wherein with the upstream end of the third main line portion.

8. The directional coupler according to claim 2, further comprising:
first to fourth outer electrodes provided on surfaces of the multilayer body;
a first lead conductor that connects the first outer electrode with the first main line portion;
a second lead conductor that connects the second outer electrode with the third main line portion;
a third lead conductor that connects the third outer electrode with the first sub-line portion; and
a fourth lead conductor that connects the fourth outer electrode with the third sub-line portion.

9. The directional coupler according to claim 8, wherein the first lead conductor and the third lead conductor have a same length.

10. The directional coupler according to claim 8, further comprising:
a fifth outer electrode provided on a surface of the multilayer body; and
a second ground conductor provided on the other side in the stacking direction with respect to the main line, the sub-line, and the first to fourth lead conductors and connected to the fifth outer electrode.

11. The directional coupler according to claim 8, wherein
the first lead conductor and the third lead conductor are provided on the other side in the stacking direction with respect to the main line; and
the second lead conductor and the fourth lead conductor are provided on the one side in the stacking direction with respect to the sub-line.

12. The directional coupler according to claim 8, further comprising:
a fifth outer electrode provided on a surface of the multilayer body; and
a third ground conductor provided at a center or approximate center of a surface on the one side of the multilayer body and connected to the fifth outer electrode.

13. The directional coupler according to claim 1, wherein the first main line portion and the first sub-line portion overlap when the first main line portion and the first sub-line portion are viewed in plan from the stacking direction.

14. The directional coupler according to claim 13, wherein the first main line portion and the first sub-line portion have a same shape when the first main line portion and the first sub-line portion are viewed in plan from the stacking direction.

15. The directional coupler according to claim 1, wherein the second main line portion and the second sub-line portion are provided on a same dielectric layer of the plurality of stacked dielectric layers.

16. A directional coupler comprising:
a multilayer body including a plurality of stacked dielectric layers;
first to fourth outer electrodes provided on surfaces of the multilayer body;
a main line including a first main line portion, a second main line portion, and a third main line portion which are connected in series to each other in this order and that is provided in the multilayer body;
a sub-line that includes a first sub-line portion, a second sub-line portion, and a third sub-line portion which are connected in series to each other in this order, the first sub-line portion being electromagnetically coupled to the first main line portion, the second sub-line portion being electromagnetically coupled to the second main line portion, the third sub-line portion being electromagnetically coupled to the third main line portion, and the sub-line being provided on one side in a stacking direction with respect to the main line in the multilayer body;
a first lead conductor that connects the first outer electrode with the first main line portion;
a second lead conductor that connects the second outer electrode with the third main line portion;
a third lead conductor that connects the third outer electrode with the first sub-line portion; and
a fourth lead conductor that connects the fourth outer electrode with the third sub-line portion; wherein
the second main line portion is provided on a dielectric layer that is different from a dielectric layer on which the first main line portion is provided and/or the second sub-line portion is provided on a dielectric layer that is different from a dielectric layer on which the first sub-line portion is provided;
the second main line portion and the second sub-line portion are disposed such that a space between the second main line portion and the second sub-line portion is smaller than a space between the first main line portion and the first sub-line portion;
the second main line portion is provided on a dielectric layer that is different from a dielectric layer on which the third main line portion is provided and/or the second sub-line portion is provided on a dielectric layer that is different from a dielectric layer on which the third sub-line portion is provided;
the second main line portion and the second sub-line portion are disposed such that a space between the second main line portion and the second sub-line portion is smaller than a space between the third main line portion and the third sub-line portion;

the first lead conductor and the third lead conductor have a same length; and when an end portion of the first lead conductor is connected with an end portion of the third lead conductor by a straight line, an isosceles triangle is defined when the first lead conductor and the third lead conductor are viewed in plan from the stacking direction.

17. A directional coupler comprising:

a multilayer body including a plurality of stacked dielectric layers;

first to fifth outer electrodes provided on surfaces of the multilayer body;

a main line including a first main line portion, a second main line portion, and a third main line portion which are connected in series to each other in this order and that is provided in the multilayer body;

a sub-line that includes a first sub-line portion, a second sub-line portion, and a third sub-line portion which are connected in series to each other in this order, the first sub-line portion being electromagnetically coupled to the first main line portion, the second sub-line portion being electromagnetically coupled to the second main line portion, the third sub-line portion being electromagnetically coupled to the third main line portion, and the sub-line being provided on one side in a stacking direction with respect to the main line in the multilayer body;

a first lead conductor that connects the first outer electrode with the first main line portion;

a second lead conductor that connects the second outer electrode with the third main line portion;

a third lead conductor that connects the third outer electrode with the first sub-line portion;

a fourth lead conductor that connects the fourth outer electrode with the third sub-line portion;

a first ground conductor provided in the multilayer body and connected to the fifth outer electrode; and first to fourth capacitor conductors connected to the first to fourth outer electrodes, respectively, and facing the first ground conductor with a dielectric layer of the plurality of stacked dielectric layers provided therebetween; wherein the second main line portion is provided on a dielectric layer that is different from a dielectric layer on which the first main line portion is provided and/or the second sub-line portion is provided on a dielectric layer that is different from a dielectric layer on which the first sub-line portion is provided;

the second main line portion and the second sub-line portion are disposed such that a space between the second main line portion and the second sub-line portion is smaller than a space between the first main line portion and the first sub-line portion;

the second main line portion is provided on a dielectric layer that is different from a dielectric layer on which the third main line portion is provided and/or the second sub-line portion is provided on a dielectric layer that is different from a dielectric layer on which the third sub-line portion is provided; and the second main line portion and the second sub-line portion are disposed such that a space between the second main line portion and the second sub-line portion is smaller than a space between the third main line portion and the third sub-line portion.

18. The directional coupler according to claim 17, wherein the first ground conductor is provided on the one side in the stacking direction with respect to the main line, the sub-line, and the first to fourth lead conductors.

19. The directional coupler according to claim 18, wherein portions of the first to fourth outer electrodes are provided on a surface of the multilayer body on the one side in the stacking direction of the multilayer body;

the first to fourth capacitor conductors are provided on the one side in the stacking direction with respect to the first ground conductor; and the portions of the first to fourth outer electrodes are accommodated within the first to fourth capacitor conductors, respectively, when the first to fourth outer electrodes are viewed in plan from the stacking direction.

* * * * *